United States Patent [19]

Nigrosh

[11] 3,973,475

[45] Aug. 10, 1976

[54] BOX FORMING MACHINE

[75] Inventor: Alvin L. Nigrosh, Wayland, Mass.

[73] Assignee: Hoague-Sprague Corporation, Boston, Mass.

[22] Filed: Dec. 20, 1974

[21] Appl. No.: 534,719

[52] U.S. Cl. ..... 93/36.3; 53/383; 93/36 MM

[51] Int. Cl.[2] ..... B31B 1/62; B31B 1/64

[58] Field of Search ..... 93/36.3, 36 MM, 36 R, 93/41, 49 R; 53/387, 383; 83/DIG. 1

[56] References Cited

UNITED STATES PATENTS

| | | | |
|---|---|---|---|
| 1,651,877 | 12/1967 | Evers | 93/36.3 |
| 2,545,549 | 3/1951 | Guill et al. | 83/DIG. 1 |
| 2,561,485 | 7/1951 | Sillars | 93/36.3 X |
| 2,624,247 | 1/1953 | Claff et al. | 93/36.3 |
| 2,757,443 | 12/1955 | Watson | 93/36.3 |
| 2,774,285 | 12/1956 | Claff et al. | 93/36.3 |
| 3,333,516 | 8/1967 | Waterworth, Sr. et al. | 93/36.3 |

*Primary Examiner*—James F. Coan

*Attorney, Agent, or Firm*—Wolf, Greenfield & Sacks

[57] ABSTRACT

A box forming machine for semi-automatic fabrication of limited production runs of boxes from a flat box blank. The machine provides a glue applying system and a pressure applying system arranged for access and use from the same side of the machine. The glue applying system includes a reservoir and glue roller and the pressure applying section includes a fixed plate and a movable plate, with the fixed plate shaped to accept box blanks of various sizes.

27 Claims, 13 Drawing Figures

FIG. 3
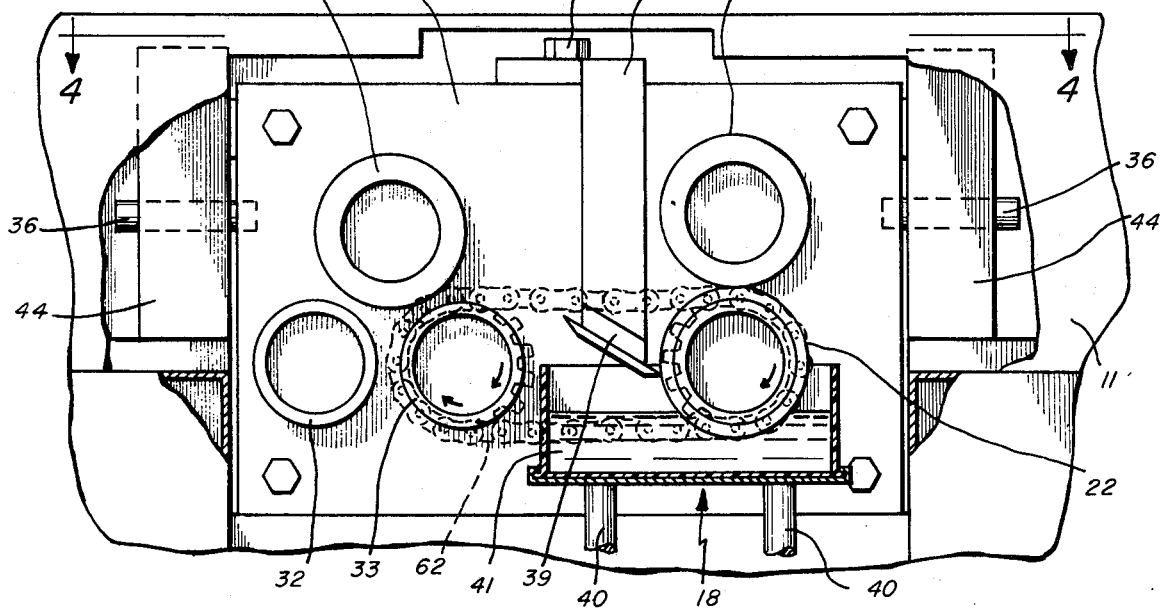
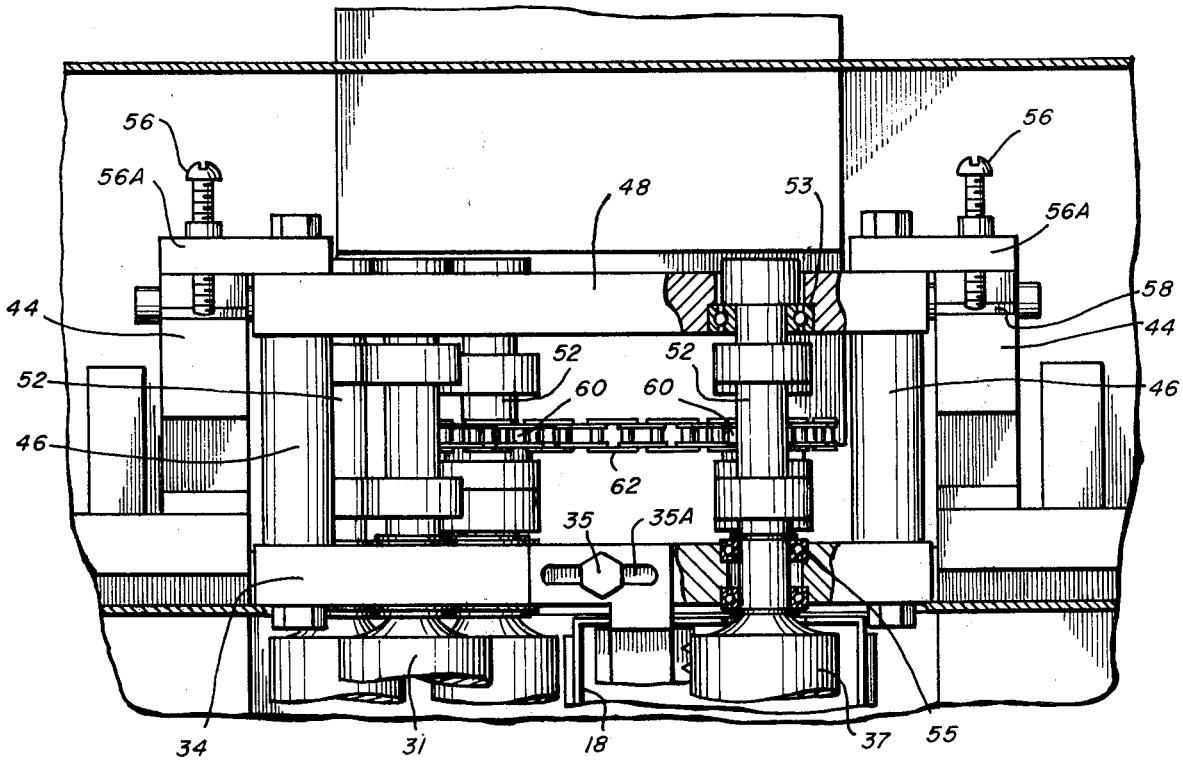
FIG. 4

BOX FORMING MACHINE

BACKGROUND OF THE INVENTION

The present invention relates, in general, to a box forming machine. More particularly, the invention is concerned with an inexpensive compact machine designed for forming set-up boxes and lids from flat box blanks.

Most box forming machines are designed for high speed production runs of uniformly shaped and sized boxes. These machines are bulky, costly, complex and require skilled personnel for their operation. For these reasons, such machines are not suited for limited production.

Accordingly, one object of the present invention is to provide a box forming machine that is specifically designed for short runs of box forming. More particularly, the present invention is designed to provide a semi-automatic means for making set-up boxes in limited numbers.

A further object of this invention is to provide a semi-automatic box making machine that is much less expensive than fully automated machines and which can be easily and safely operated by unskilled personnel with very little instruction.

A further object of this invention is to provide a semi-automatic box making machine especially designed to make set-up boxes of different sizes, successively, without requiring changes in the machine set-up. Box forming machines made in accordance with the present invention are particularly useful in retail stores and the like where limited numbers of boxes for each day's sales may be fabricated each morning from conveniently stored box blanks. This system will reduce costs because box blanks are less expensive to buy and store than are the finished boxes. In addition, prudent use of store personnel who are otherwise not busy, will limit or even avoid costs in fabrication of the boxes from the blank at the store.

Another object of this invention is to provide a box forming machine that has readily removable glue reservoir and associated glue applying roller. With the arrangement of this invention the container or reservoir for the glue and the roller are removed in one operation and can be easily cleaned and replaced on the machine.

SUMMARY OF THE INVENTION

To accomplish the foregoing and other objects of this invention, there is provided a box forming machine that is designed to glue one end of a box blank and thereafter glue the other. The glue application system comprises means for feeding a flat box blank through a series of rolls by means of which glue is transferred from a reservoir to an edge area of the box blank. After an edge area has been coated with glue the box is partially folded and pressure is applied to the fold for a predetermined period of time. The pressure applying means is accessible from the same side of the machine as the glue applicator. It includes a fixed platen, a movable platen and means for forcing the movable platen toward and away from the fixed platen. This mechanism may be solenoid operated. The fixed platen has a series of parallel passages or slots to accommodate box blanks that are used for making different size boxes. These slots are designed so that different sized boxes can be made successively without machine adjustment. In one disclosed embodiment the glue application system comprises a container and a glue application roller that is slotted to accommodate opposite ends of the container. One wall of the container forms a scraper or doctor blade and the container and roller may be easily removed in one action so that they can be cleaned.

BRIEF DESCRIPTION OF THE DRAWINGS

Other objects, features and advantages of the invention will be understood by reading the following detailed description, taken in conjunction with the accompanying drawings, in which:

FIG. 3 is a cross-sectional view taken along line 3—3 of FIG. 2;

FIG. 4 is a cross-sectional view taken along line 4—4 of FIG. 3 and showing the feed mechanism of the present invention;

DETAILED DESCRIPTION

Figure 1:
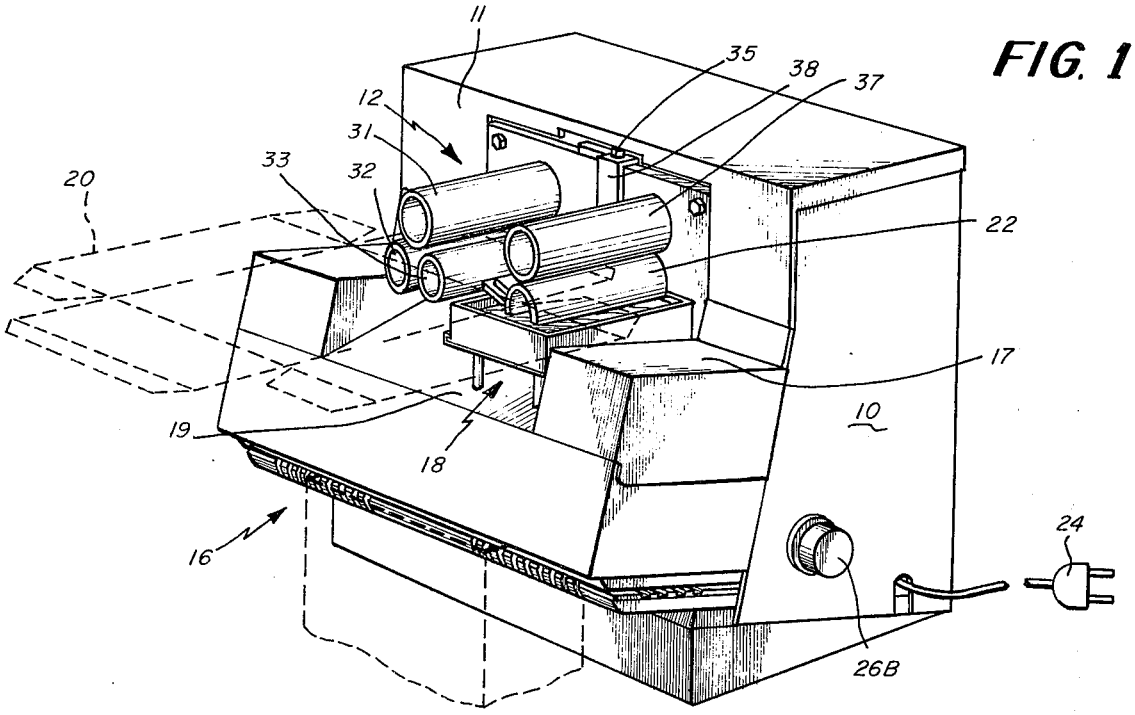
FIG. 1 is a perspective view of the machine of the present invention.

FIG. 1 is a perspective view of the machine of the present invention. The machine comprises a housing 10, a feed mechanism 12, a pressure mechanism 16, and a glue holder 18. FIG. 1 shows a box blank 20, in phantom, being moved through the feed mechanism so as to contact the glue transfer roller 22 thereby applying a glue film to an edge area of the box blank 20. The roller 22 may be made of rubber and may have a ribbed structure although in this embodiment the scraper and not the roller is ribbed. FIG. 1 also shows, in phantom, the box blank in a folded condition and inserted into the pressure mechanism 16.

Figure 2:
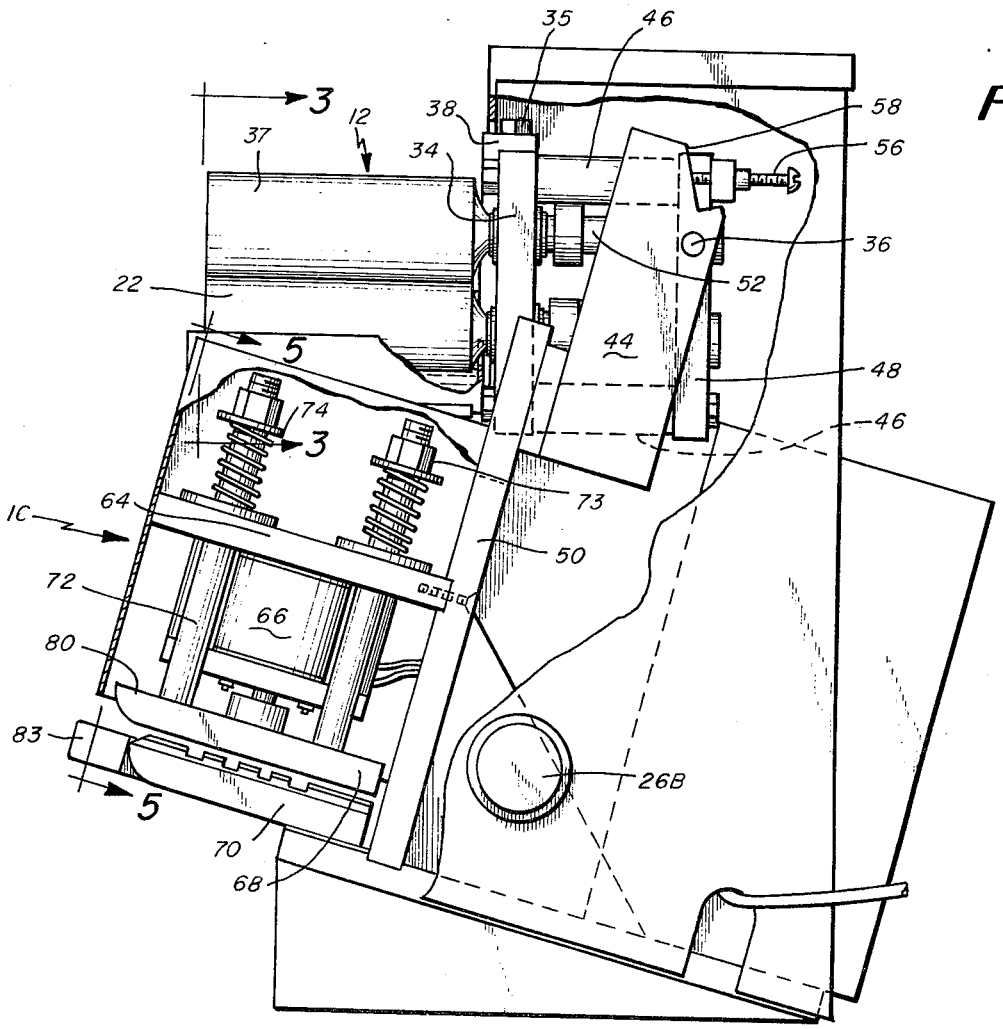
FIG. 2 is a side view, partially cut-a-way, of the machine shown in FIG. 1.

The control of the machine of this invention is semi-automatic, and in FIG. 1 there is shown an AC power plug 24 for coupling power to the machine. Two actuating switches 26A and 26B are also provided, only one of which is shown in FIG. 2. The operation of these electrical components is discussed in more detail hereinafter with reference to the schematic diagram shown in FIG. 9.

The feed mechanism 12 and the glue applying mechanism 16 are shown in more detail in FIGS. 2–4. The feed mechanism 12 comprises suitably supported feed rolls 31, 32 and 33. These feed rolls extend from a support plate 34. Roller 37 frictionally contacts transfer roller 22 which extends into the reservoir tank 18 designed to contain a pressure sensitive adhesive. The rollers 37 and 22 are also both rotatably supported on plate 34. The plate 34 supporting rollers 31, 32, 33, 37 and 22 is engaged by pins 36 that extend behind the cut-a-way in front wall 11 as shown in FIGS. 1 and 3. The plate 34 may be pivoted about pivot pins 36. When the plate 34 is pivoted the entire feed mechanism is also pivoted therewith. This pivoting movement is permitted so that the feed mechanism 12 can assume different positions relative to the surface 17. Depending upon many factors such as the size of the operator, it may be desirable to have the feed mechanism tilted at different angles. In FIG. 2 the mechanism is adjusted to a substantially horizontal position. The support for the feed roller is shown and discussed in more detail hereinafter with reference to FIG. 4.

A doctor blade or scraper 39 (FIGS. 1 and 3) is suitably supported by bracket 38 and lies, with its edge close to the transfer roller 22. As roller 22 rotates excess glue is removed from it by the scraper 39. The bracket 38 is secured at its top end to plate 34 by means of bolt 35. A slot 35A (FIG. 4) is provided to afford some adjustment for bracket 38.

A reservoir tank 18 (FIGS. 1 and 3) is supported above the surface 19 of the housing by suitable means, such as a pair of legs 40. The reservoir tank 18 is of generally rectangular shape and may be filled with a conventional glue 41 in a liquid form. As previously mentioned, the scraper 39 removes excess glue from the roll 22 and redeposits it back in the reservoir.

FIGS. 2 and 4 show in more detail the means for supporting the feeding rollers. As previously indicated, this support includes plate 34 and rear support plate 48 which are secured in spaced relation by corner supports 46. The entire assembly, including the feed rollers, the support plates 34 and 48 is supported for pivotable movement through a limited angle about pins 36 which extend into plates 44. Plates 44, in turn, are secured to a fixed panel plate 50 (FIG. 2).

Each of the feed rollers, including rollers 31, 32, 33, 37 and 22, that extend from plate 34 are supported for rotation by corresponding support shafts 52 (FIG. 4). Each shaft in turn is supported by a bearing 53 in plate 48 and a bushing 55 in plate 34. The ends of the shafts 52 are suitable connected each to one of said rollers.

A pair of adjusting bolts 56 (FIGS. 2 and 4) are threaded through flanges 56A which in turn are suitably secured to the plate 48 at opposite edges. The ends of these bolts bear against the faces of plate 44. The bolts may be adjustably threaded in plates 44 to adjustably rotate and fix the entire feeding mechanism in different selected positions about a generally horizontal axis.

Two of the shafts 52, as shown in FIG. 4, also have associated therewith sprocket gears 60. The two shafts that have these sprocket gears are the shafts that support the rollers 22 and 33. A sprocket chain 62 extends between these two gears and thus, in effect, ties the two shafts together so that one rotates with the other. When a box blank is inserted and contacts roller 33, this roller is rotated in the direction of the arrows shown in FIG. 3 and the roller that is coupled therewith by means of the chain 62, namely roller 22, is also caused to rotate. Therefore, before the blank has reached roller 22 glue is coating this roller and readying it for passage of the blank.

Thus, in the operation of the machine of the present invention, the initial step is to insert a box blank, as shown in FIG. 1, through the feed roll system so that an edge of one of the flaps of the box, passes adjacent to the glue transfer roller 22 causing glue to be applied along the box edge area. With reference to the box blank 20 shown in FIG. 7, the glue may be originally apped to the flap 21. A further fold may be provided along fold line 21A to provide a final configuration as shown in FIG. 8. The box is then in a condition for acceptance by the other section of the device which is the pressure section 16, as shown in FIG. 2.

Figure 5:
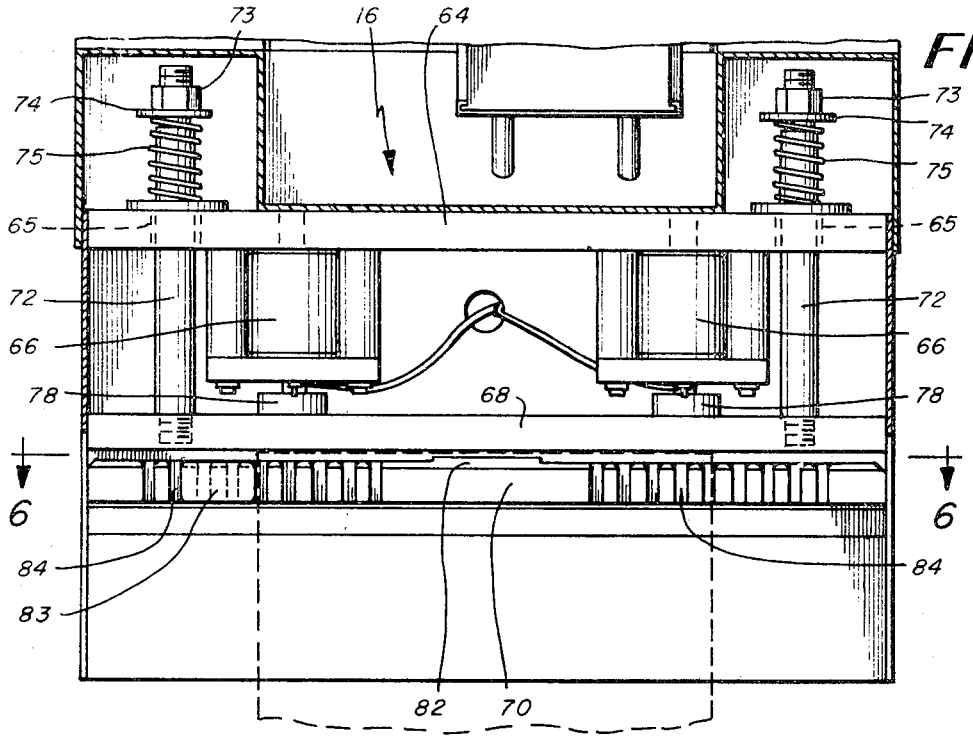
FIG. 5 is a cross-sectional view taken along line 5—5 of FIG. 2.

FIG. 5 is a cross-sectional view taken along 5-5 of FIG. 2 and shows the pressure section 16 which generally comprises a top support plate 64, solenoids 66, movable plate 68 and fixed plate 70. As indicated in FIG. 2, the support plate 64 is suitably secured to plate 50 by a suitable fastening arrangement. Four corner guide posts 72 extend between plate 68 and plate 64. Each of the guide posts is threadedly secured to the plate 68 and passes through an aperture 65 in the plate 64. The top of each of these guide posts is threaded to receive a nut 73 having a washer 74 disposed therebelow. A spring 75 extends between the washer 74 and a flat plate 76. The spring 75 biases the plate 68 away from the plate 70 in the absence of an overcoming force applied by the solenoids to plate 68.

The solenoids 66 may be of conventional design and are suitably attached to the support plate 64. The output end 78 of the solenoid is connected to the movable plate 68. When the solenoids 66 are operated, the output of these solenoids moves the plate 68 downwardly for as long as the solenoids are operated. When the solenoids are de-energized, then the springs 75 return the plate 68 to its upper position.

As also indicated in FIG. 2, the plate 68 is relatively flat on both its top and bottom surfaces and has an arcuate forward end 80 for facilitating movement of the folded box between the plates 68 and 70.

Figure 6:
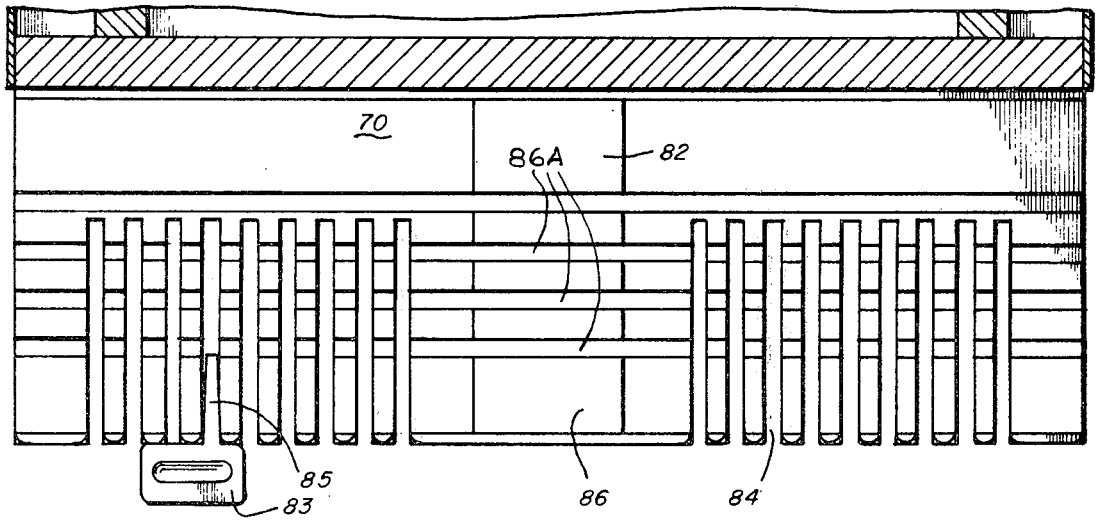
FIG. 6 is a cross-sectional view taken along line 6—6 of FIG. 5.

A plan view of the plate 70 is shown in FIG. 6. A front view of the plate showing the raised portion 82 is shown in FIG. 5. The raised portion 82 accommodates the thinner center of the folded box where the flaps 23A and 25A do not cover flap 21A (see FIG. 7). The fixed plate 70 is provided with a plurality of slots 84 disposed on either side of the solid center section 86. In the embodiment shown, there are nine such slots on either side of the center section 86. These different arranged slots permit use of boses of different size. FIG. 5 shows, in phantom, an outline of a box inserted in one of the sets of slots.

FIGS. 5 and 6 also show the stop 83 having an arm 85 extending therefrom. Arm 85 can be inserted in the desired slot 84 and the use of the stop provides further ease of operation of this invention.

Figure 7:
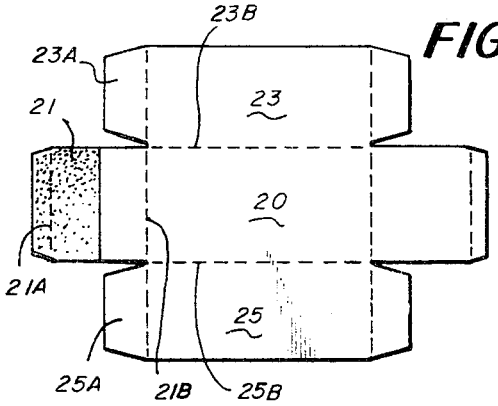
FIG. 7 shows a typical box blank in its unfolded state.
Figure 8:
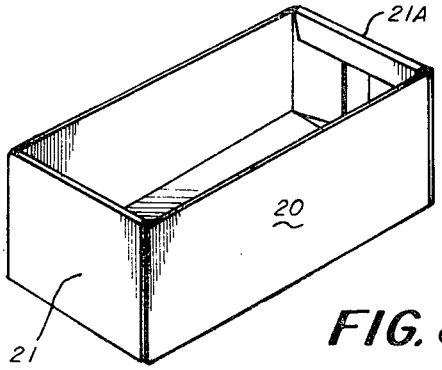
FIG. 8 is a perspective view showing the box blank of FIG. 7 folded into a box.

As previously mentioned with reference to FIG. 7, after the glue has been applied to one end of the flap of the box blank, the box blank is then hand folded by the operator along crease lines 23B, 25B, 21B and 21A to the configuration shown at one end of FIG. 8. In this position the flaps are not permanently bonded because the glue is a pressure sensitive glue. The folded end of the box is then inserted in the slots 84, as depicted in FIG. 5 where pressure is applied to the box so as to secure together the glued surfaces. When pressure is to be appled the switches 26A and 26B are concurrently actuated. This energizes the solenoids 66 for a predetermined time period and the glued and folded flaps are pressed between the plates 68 and 70. When the solenoids are de-energized the plates separate and the box may be removed.

One important feature of this invention is the inclusion of two actuating switches which assures that one hand of the operator is not free and thus prevents possible injury to the free hand had only one switch or foot switch been used.

Figure 9:
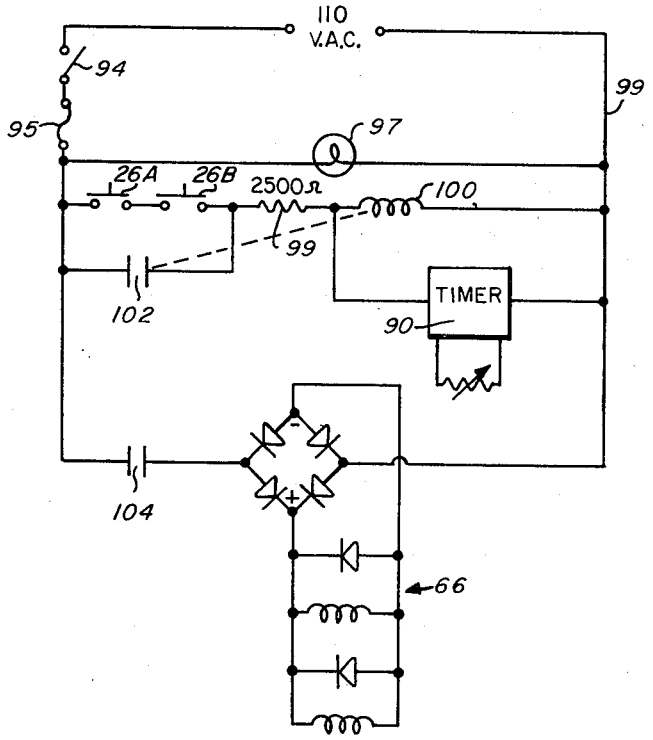
FIG. 9 is an electrical schematic associated with the machine of this invention.

FIG. 9 shows the circuit diagram associated with the machine of the present invention. In FIG. 9 there is shown a timer 90, switches 26A and 26B, an on-off switch 94, and solenoids 66. The switch 94 connects on one side to the 110 VAC line and couples through fuse 95 and light 97 to the common line 99. When switch 94 is closed and switches 26A and 26B are both closed, power is applied to the timer by way of line 96 and limiting resistor 99. At the same time that the predetermined time period of the timer is initiated relay coil 100 is also energized and its associated contact 102 closes thereby assuring that the time period continues even if one of the switches 26A or 26B is opened. The time period of operation of the timer may be preset by an adjustment (not shown) on the timer 90. The timer 90 may be a time delay relay and has a contact 104 associated therewith that permits the 110 VAC signal to be coupled to full wave bridge circuit 98. Circuit 98 is conventional and includes four interconnected diodes. The output from the full wave bridge circuit couples to the solenoids 66 to cause operation thereof for the timer period determined by timer 90 and in turn the closure time of contact 104. When this time period has elapsed the AC signal is terminated and the solenoids 66 become de-energized. As previously mentioned with reference to FIG. 2, for example, while the solenoids 66 are energized the pressure is being applied to the folded flap of the box that is being formed.

FIG. 8 shows the box when it has been completely formed in an essentially double step operation wherein one end is first glued, folded and pressed and then the other end is glued, folded and pressed.

Figure 10:
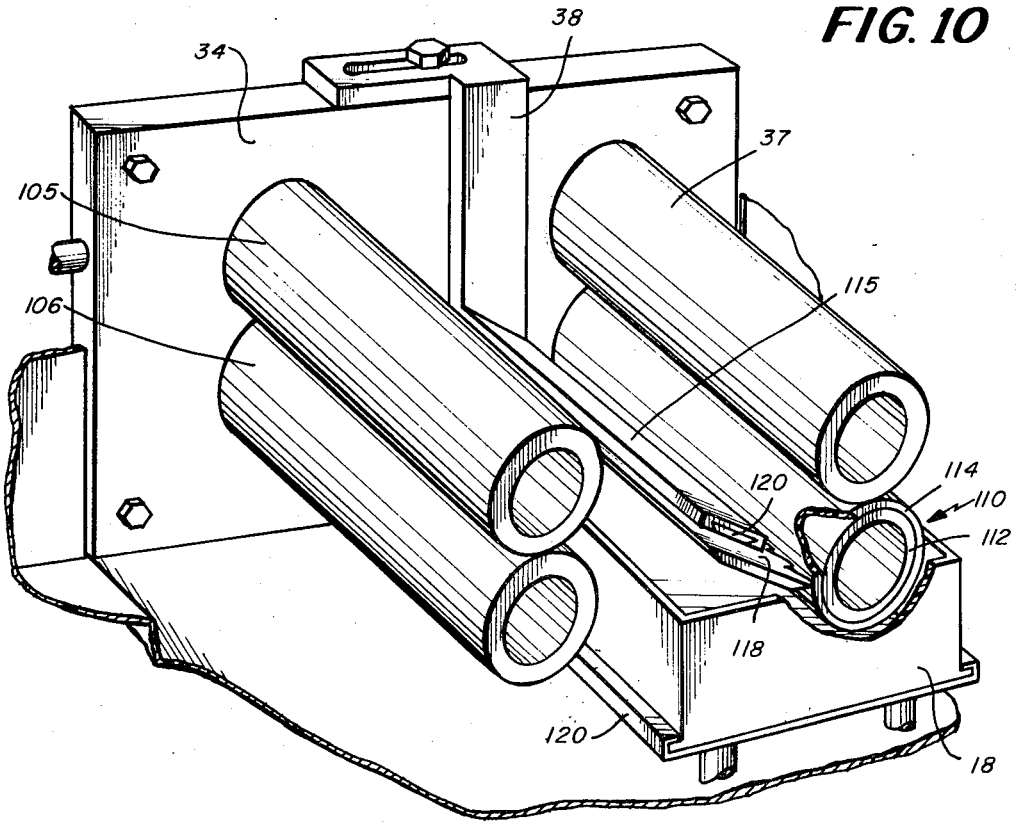
FIG. 10 is a perspective view of a slightly different embodiment and showing a disposable glue roller and replaceable scraper blade.

FIG. 10 is a perspective view showing a slightly different embodiment than the one shown previously in FIG. 1, for example. It is noted in the embodiment of FIG. 1 that there are provided five feed rollers whereas in the embodiment of FIG. 10, only four feed rollers are employed. In FIG. 10 like reference characters will be used where they correspond to like parts shown in FIG. 1.

FIG. 10 shows the rollers 37, 105 and 106 extending from the support plate 34. These rollers may be suitably supported such as by the means disclosed in detail hereinbefore in FIGS. 2–4. There is also provided extending from plate 34, a two piece glue applying roller 110 comprising a roller core 112 and a disposable outer roller 114. The outer roller 114 is dimensioned to fit snugly on the roller core 112.

FIG. 10 also shows the scraper support 38 affixed to plate 34. An elongated holder 115 extends from support 38 and carries a serrated doctor blade 118. A dove-tail joint 120 is provided so that the doctor blade 118 can be easily slid into and out of the elongated holder 115. This arrangement provides for easy replacement of the doctor blade 118 should it become clogged or inoperative for any other reason.

FIG. 10 also clearly shows the reservoir tank 18 for holding the glue. This tank is slidable along a guide channel 120 which permits the reservoir to be removed when the roller 110 is also removed.

Figure 11:
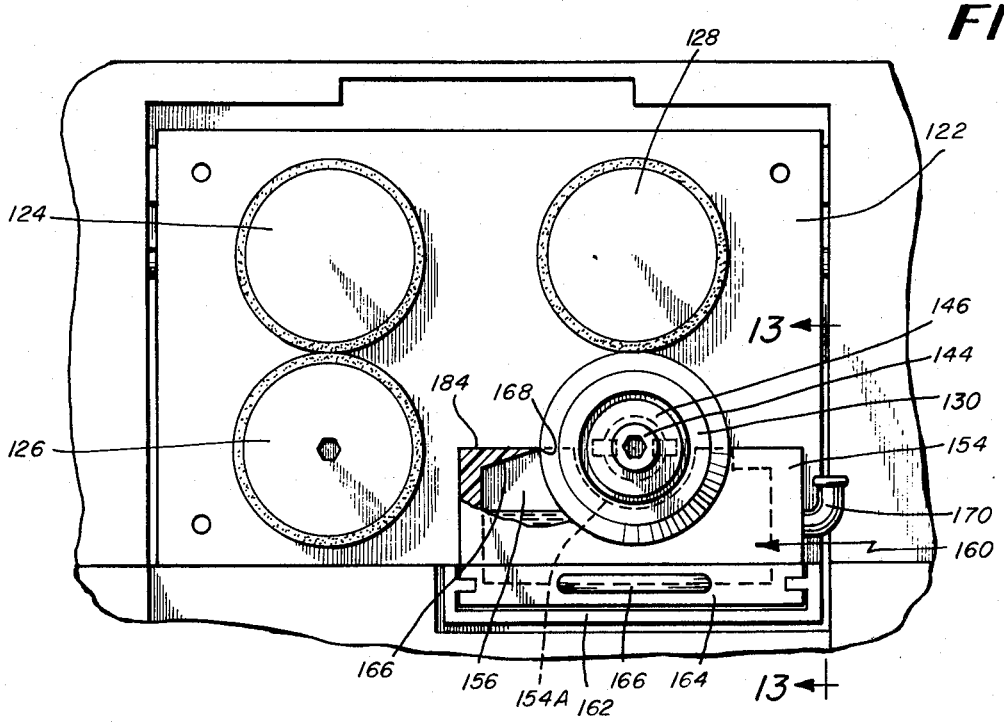
FIG. 11 is a front view similar to the one shown in FIG. 3 for an alternate embodiment and showing part of the glue container cut away.
Figure 12:
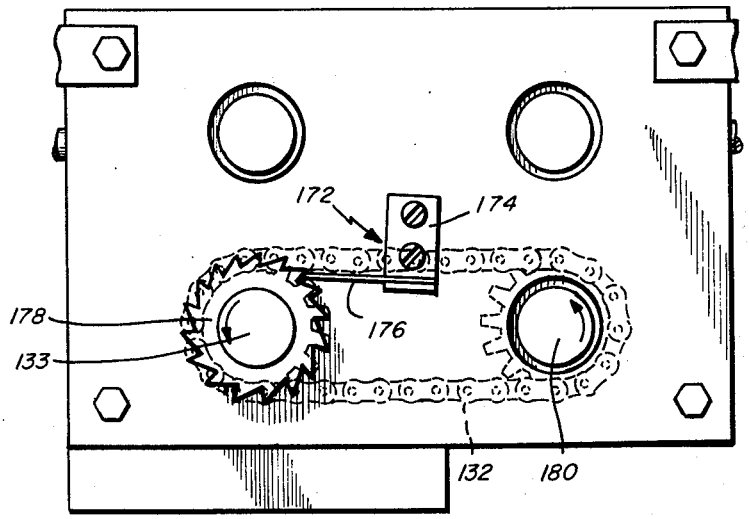
FIG. 12 shows a part of the rear of the machine shown in FIG. 11.
Figure 13:
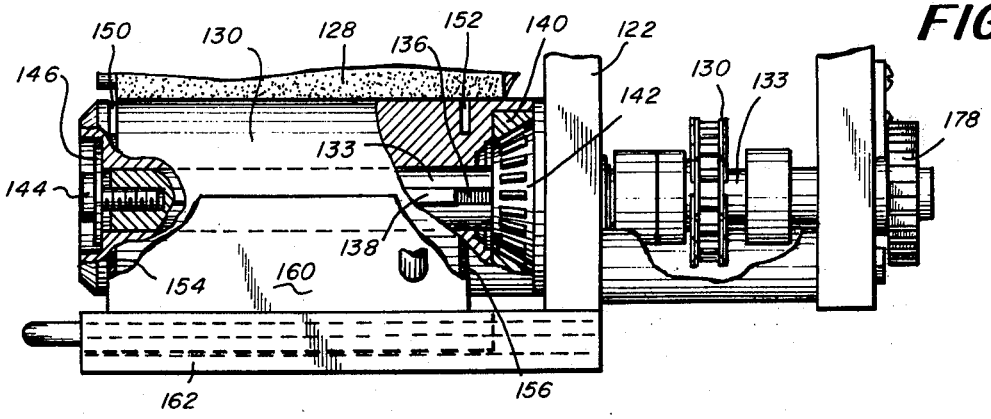
FIG. 13 is a cross-sectional view taken along line 13—13 of FIG. 11 with parts thereof cut away.

FIG. 11 shows a slightly different embodiment of the present invention. FIG. 12 shows a rear view of the machine and FIG. 13 is a cross-sectional view showing the glue application roller and the drive means associated therewith.

FIG. 11 is actually a fragmentary view intending to show only a portion of the machine having to do with the section for applying glue to the box blank. This portion of the apparatus comprises a support plate 122 having rollers 124, 126 and 128 extending therefrom. Each of these rollers has an outer rubber cover as shown in FIG. 11. There is also provided a glue application roller 130, the details of which are shown most clearly in FIG. 13. A drive is provided by means of sprocket 132 between roller 126 and roller 130, so that when the box blank is inserted between rollers 124 and 126, and is moved toward rollers 128 and 130, the rollers 126 and 130 are rotated in unison. The sprocket 132 is also shown in FIG. 13 as extending about a sprocket gear on support shaft 138. Shaft 133 is suitably supported and extends from support plate 122 forwardly as shown in FIG. 13.

The roller 130 is supported on the shaft 133 by means of a key arrangement including at least one longitudinal slot 136 in the shaft and a key 138 that fits within the slot 136 and in a similar slot in the roller 130. The roller 130 has a bearing race 140, pressure fitted at one end, and a cone bearing 142 is provided as an intermediate support between the shaft 133 and the glue applying roller 130. At the opposite end the roller 130 is fixed relative to the shaft by means of a bolt 144 and washer 146 which secure the roller against longitudinal movement relative to the shaft.

The roller 130 is also provided with annular slots 150 and 152 near the opposite ends of the roller. These slots accommodate the front wall 154 and the rear wall 156, respectively, comprising two walls of the glue container 160. As noted in FIG. 13 there is a slight space between the arcuate cut-outs in the walls 154 and 156 and the bottom of the slots 150 and 152. FIG. 11 shows the arcuate cut-out section 154A in wall 154.

The machine also comprises a base member 162 which defines a channel for the bottom 164 of the glue container 160. The glue container is free to move in the channel until the roller 130 is affixed to the shaft. In order to pull the container 160 a handle 166 is provided.

If the roller and container are in the position shown in FIG. 13 and it is desired to remove both of these items, then the bolt 144 is simply removed. Next, the container 160 and the roller 130 can be pulled forwardly by means of the handle 166. Because of the arcuate slots in the front and rear walls of the container and the corresponding annular slots in the roller, both the container and roller are removed as a unitary structure. Similarly, the roller and container can be replaced in the same manner by inserting the roller into the container. The roller is then rotated slightly until it can be keyed onto the shaft. Then the roller and container are moved together onto the shaft and affixed in place by the bolt 144.

With the arrangement shown in FIGS. 11-13, it is also advantageous to provide a scraper for the roller which in this case is provided by an inner beveled wall 166 at the top of the container. This beveled wall is shown in FIG. 11 as terminating at a scraping edge 168 which removes excess glue from the roller as it is rotated on shaft 133.

FIG. 11 also shows the filler pipe 170 through which glue may be poured in order to fill the container 160.

In order to prevent the sprocket 130 from driving in the wrong direction, there is provided a pawl arrangement 172 shown in FIG. 12. The pawl 172 includes a holder 174 and an arm 176 secured to the holder and extending to a ratchet 178 which is secured to the end of shaft 133. The arm 176 permits rotation of the shaft 133 in the direction shown by the arrows in FIG. 12. However, if an operator of the machine should attempt to even slightly rotate either the shaft 133 of the corresponding shaft 180 in the wrong direction, then the arm 176 would prevent this attempted reverse rotation. This operation prevents the build-up of glue on the top surface 184 (see FIG. 11) of the container 160. If the roller 130 were permitted to rotate in this opposite direction then a substantial amount of glue may build up on surface 184. This is wasteful and may require excessive cleaning of the container.

Referring once more to FIG. 6, there is illustrated a series of transversely extending grooves 86A which are perpendicular to the parallel slots 84. These grooves 86A extend slightly into the platen to a depth preferrably sufficient to accommodate one or two typical thicknesses of cardboard of which the boxes are formed. These grooves provide relief sections designed to receive the edges of the boxes in an area as illustrated at 21A in FIG. 8 as the box is being formed. By locating the edge of the box end over a groove as it is being formed greater pressure can be applied to the folded portions of the box so as to increase the efficiency of the pressure being applied. In addition there is less likelihood of damaging the edge of the box during its formation.

Having described a preferred embodiment of the present invention, it should now become apparent to those skilled in the art that numerous modifications can be made in this embodiment, all of which are contemplated as falling within the scope of the present invention. For example, the feed rollers have been disclosed as being supported in a particular manner. Obviously, other support could be provided for the feed rollers. Also, one particular circuit schematic has been shown but other timers, for example, could be used. Also, a different type of full wave circuit could be provided.

What is claimed is:

1. A box forming machine comprising;

a reservoir for a liquid glue, means for feeding a flat box blank adjacent the glue reservoir, means for transferring glue from the reservoir to an edge area of the box blank, and means receiving one end of a partially folded box blank for applying pressure to the folded end for a predetermined period of time including a fixed platen having a plurality of lengthwise slots permitting accommodation of boxes of different sizes, a movable platen and means for forcing the movable platen toward and away from the fixed platen.

2. A box forming machine as set forth in claim 1 wherein said means for forcing includes an electromechanical means.

3. The machine of claim 1 wherein said fixed platen has a solid center section with a raised area.

4. The machine of claim 1 wherein said means for feeding includes a plurality of feed rollers and said means for transferring includes a glue transfer roller that frictionally contacts one of the feed rollers.

5. A box forming machine as set forth in claim 2 including a source of power and switch means for coupling the power to the electromechanical means.

6. A box forming machine as set forth in claim 5 including a timer responsive to operation of said switch means for operating said electromechanical means for a predetermined time interval.

7. The machine of claim 4 wherein said feeding means includes an interconnecting belt or chain coupled between said one of the feed rollers and another feed roller that is forward of the one feed roller so that both rollers rotate in unison.

8. A box forming machine as set forth in claim 5 wherein said switch means includes a pair of switches both of which are actuated to couple power to the electromechanical means.

9. The machine of claim 7 including a scraper for scraping excess glue from the glue transfer roller.

10. The machine of claim 1 wherein said means for forcing the movable platen includes electromechanical means and control means coupled to said electromechanical means.

11. The machine of claim 10 wherein said control means includes a timer and operator controlled switch means for initiating operation of the timer.

12. The machine of claim 11 further including a light source that is illuminated during the time the timer is on and a full wave bridge circuit coupled between the timer and electromechanical means.

13. A box forming machine comprising;

means for commonly supporting a system for applying adhesive to at least one end of a box blank, and means for applying pressure to a box blank at an end which has been partially coated with adhesive and at least partially folded into the shape of a box whereby said adhesive may be set, said system including a plurality of parallel rollers, means for adjustably securing said rollers at selected angles to a horizontal position, and an adhesive container positioned to transfer adhesive to said rollers for application to a box blank passed therebetween, said rollers and said support providing unobstructed access to the path of movement of said box blank from one axial end of said rollers, and said pressure applying means accessible for insertion of a box blank from the same side of said machine as the side of said one axial end of said roller.

14. A box forming machine as set forth in claim 13 wherein said pressure applying means includes a pair of manually actuatable switches both of which are actuated to control the application of pressure.

15. A machine as set forth in claim 13 wherein said pressure applying means includes a pair of platens, means for moving said platens from a position in normal spaced relation to a position in pressured relation and with one of said platens including a plurality of slots extending from an edge of said one platen to receive the sides of said box blank.

16. In a box forming machine, means for applying pressure to one end of a box blank which has been at least partially coated with adhesive and generally shaped into the end of a box comprising;

a pair of platens, defining a space therebetween to receive one end of a box during fabrication thereof, means for moving one of said platens toward the other for application of pressure to said one box end, one of said platens having a plurality of parallel slots extending from one edge thereof to receive the portions of the sidewalls of said partially formed box adjacent said one box end.

17. A box forming machine as set forth in claim 16 wherein one of said platens is provided with a plurality of parallel grooves extending normal to said parallel slots adapted to receive an edge of one of said sidewalls of said partially formed box.

18. A box forming machine comprising;

a reservoir for a liquid glue, means for feeding a flat box blank adjacent the glue reservoir, means for transferring glue from the reservoir to an edge area of the box blank, including a roller extending at least partially into the reservoir and said reservoir comprising a multiple walled container having means defining an edge in the form of a scraper adjacent the roller for removing excess glue from the roller, wherein the roller has annular slots at opposite ends thereof and said container has opposite end walls cut away to receive the slots of the roller, and means receiving one end of a partially folded box blank for applying pressure to the folded end for a predetermined period of time including a fixed platen, a movable platen and means for forcing the movable platen toward and away from the fixed platen.

19. The machine of claim 18 including means defining a track for said container to slide along and a handle for moving said container.

20. The machine of claim 19 including a shaft for supporting said roller and means keying the roller to the shaft.

21. The machine of claim 18 wherein the means defining an edge comprises an upright wall of the container having an integral extending top edge extending toward the roller and forming the scraper.

22. A box forming machine comprising;

a reservoir for a liquid glue, means for feeding a flat box blank adjacent the glue reservoir, means for transferring glue from the reservoir to an edge area of the box blank, including a roller extending at least partially into the reservoir and said reservoir comprises a multiple walled container having means defining a top edge formed integrally with said container and defined in the form of a scraper adjacent the roller for removing excess glue from the roller, and means receiving one end of a partially folded box blank for applying pressure to the folded end for a predetermined period of time including a fixed platen, a movable platen and means for forcing the movable platen toward and away from the fixed platen.

23. The machine of claim 22 wherein said scraper is defined in a top wall of the container having a beveled surface terminating in the elongated scraper.

24. A box forming machine comprising;

a reservoir for a liquid glue, means for feeding a flat box blank adjacent the glue reservoir, said means for feeding including a support structure and means for pivotally swinging the support structure through a small angle, means for transferring glue from the reservoir to an edge area of the box blank, and means receiving one end of a partially folded box blank for applying pressure to the folded end for a predetermined period of time including a fixed platen, a movable platen and means for forcing the movable platen toward and away from the fixed platen.

25. The machine of claim 24 including adjusting means for fixing the support structure in the desired position.

26. A box forming machine comprising:

a reservoir for a liquid glue, means for transferring glue from the reservoir to an edge area of the box blank, including a roller extending into the reservoir, said roller having annular slots at opposite ends thereof and said reservoir having opposite end walls for receiving the slots of the roller, and means receiving one end of a partially folded box blank for applying pressure to the folded end for a predetermined period of time including a fixed platen, a movable platen and means for forcing the movable platen toward and away from the fixed platen.

27. A box forming machine comprising;

a reservoir for containing a liquid glue, roller means disposed above the reservoir for transferring glue from the reservoir to an edge area of the box blank, means for supporting the roller means including means for permitting the roller means to pivotally swing through a small angle, means disposed adjacent or contacting the roller means for removing excess glue therefrom, means for applying pressure to a box blank at an end which has been partially coated with adhesive and at least partially folded into the shape of a box whereby said adhesive may be set and including a pair of platens between which the blank is inserted.

* * * * *